US007051546B2

(12) United States Patent
Hirao et al.

(10) Patent No.: US 7,051,546 B2
(45) Date of Patent: May 30, 2006

(54) DEFROSTING SYSTEM USING COMPRESSED AIR

(75) Inventors: Yasuhiro Hirao, Tokyo (JP); Kazuyuki Iwase, Tokyo (JP); Takeshi Kamimura, Tokyo (JP)

(73) Assignee: Mayekawa Mfg. Co., Ltd., Tokyo (JP)

( * ) Notice: Subject to any disclaimer, the term of this patent is extended or adjusted under 35 U.S.C. 154(b) by 128 days.

(21) Appl. No.: 10/792,282

(22) Filed: Mar. 4, 2004

(65) Prior Publication Data

US 2005/0193756 A1 Sep. 8, 2005

(51) Int. Cl.
*F25D 21/00* (2006.01)

(52) U.S. Cl. ..... 62/282; 62/151

(58) Field of Classification Search ..... 62/151, 62/172, 186, 282

See application file for complete search history.

(56) References Cited

U.S. PATENT DOCUMENTS

| | | | | |
|---|---|---|---|---|
| 4,528,820 | A | 7/1985 | Jonasson | |
| 4,570,447 | A | 2/1986 | Jonasson | |
| 5,528,900 | A * | 6/1996 | Prasad | 62/175 |

FOREIGN PATENT DOCUMENTS

| | | |
|---|---|---|
| JP | 62-22067 | 5/1987 |
| JP | 8-5207 | 1/1996 |

* cited by examiner

*Primary Examiner*—Melvin Jones
(74) *Attorney, Agent, or Firm*—Crowell & Moring LLP

(57) ABSTRACT

Defrosting frost deposited on the coolers disposed in a refrigerating-storage room for cooling the room can be carried out without the necessity of stopping the operation of refrigerating cycle and with low cost and high efficiency. Compressed air is blown to the coolers by means of nozzles to which the compressed air is supplied intermittently.

7 Claims, 4 Drawing Sheets

DEFROSTING SYSTEM USING COMPRESSED AIR

BACKGROUND OF THE INVENTION

1. Field of the Invention

The present invention is related to a defrosting system for removing frost deposits from the cooling device (cooler) in a refrigerating system, specifically a defrosting system for removing the frost deposits using compressed air.

2. Description of the Related Art

Generally, cooling devices (cooler) are provided in a refrigerating system for cooling articles such as foodstuffs accommodated in a cold-storage room, and each of the cooler is composed of a cooling-coil onto the outer surface of which frost is deposited due to the moisture in the storage room. When frost is deposited on the cooling coil, the value of heat transfer coefficient decreases and as a result refrigerating capacity is reduced. Therefore, the frost deposited on the cooler must be removed at regular intervals.

A variety of methods are known for removing frost deposits from a cooling device. For example, there is known a method in which the flow of refrigerant is reversed so that the evaporator functions as a condenser. With this method, the cooling operation must be switched off during the defrosting operation and the articles such as foodstuffs accommodated in the storage room may be affected. There is also known a method in which an electrically heating coil is provided around the cooler (for example, a cooling coil) to melt and remove the frost deposited on the surface of the cooling coil. Further, there is known a method in which water is sprinkled onto the surface of the cooling coil to melt and remove the frost on the surface of the cooling coil.

In the above-mentioned methods, cooling operation must be stopped temporarily for removing the frost from the cooler. Therefore, an additional time is required for refrigerating the articles such as foodstuffs at least for the time period the cooling operation is stopped. That means that the time period required for refrigerating the articles such as foodstuffs increases.

On the other hand, an apparatus for recurrently removing frost deposits from cooling-coil batteries without stopping cooling operation for carrying out defrosting, is disclosed in U.S. Pat. No. 4,570,447(hereafter referred to as prior art 1), in which cooling coils are scanned by compressed pulsating air streams for removing frost deposits from the cooler. Further, in Japanese Laid-Open Patent Application No. 8-5207(hereafter referred to as prior art 2) is disclosed a defrosting apparatus in which rotating wings are provided to the rotating hollow shaft located in the air suction side of a cooling device, the rotating wings being rotated by the suction air flow sucked by the fan of the cooler, nozzles are provided to face the cooler, the nozzles being fixed to air blowing pipes attached to the rotating hollow shaft so that the air blowing pipes communicate to the hollow of the rotating hollow shaft, an air supply pipe is connected to the rotating hollow shaft by means of a rotary joint, and the discharge opening of an air compressor is connected to the air supply pipe. With this construction, the cooling coil is defrosted by compressed air.

In prior art 1, the defrosting is carried out by scanning the cooling coils with compressed pulsating air streams blowing out from nozzles. However, a plurality of nozzles are required in a refrigerating system in which a plurality of cooling coils are provided in a storage room. Therefore, if it is intended to supply compressed air to the nozzles by an air compressor, the capacity of the air compressor must be inevitably large, as a result, the cost of the defrosting system, in its turn the refrigerating system itself increases.

Further, with prior art 1, as compressed pulsating air streams are blown continuously to the cooler (cooling coils), the workload of the air compressor is high and energy efficiency is low. This is true also for prior art 2. Therefore, both prior art 1 and prior art 2 can not carry out the defrosting of cooler with low cost and high efficiency.

SUMMARY OF THE INVENTION

The object of the present invention is to provide a defrosting system capable of carrying out the defrosting of the cooler disposed in a refrigerating-storage room with low cost and high efficiency.

The present invention proposes a defrosting system for removing frost deposits from the cooling device disposed in a refrigerating-storage room for cooling the inside of the room, comprising a compressed air blowing means to blow compressed air on to said cooling device or devices, and a compressed air supply means to supply compressed air intermittently to said compressed air blowing means.

The defrosting system of the present invention is configured such that said compressed air supply means comprises an air tank for storing compressed air, a compressor unit for supplying compressed air to said air tank, and a control means for controlling so that the compressed air in said air tank is supplied intermittently to said compressed air blowing means, and, for example, said control means comprises a valve mechanism disposed between said compressed air blowing means and said air tank, and a control unit for allowing the valve mechanism to open intermittently to supply compressed air from said air tank to said compressed air blowing means.

It is preferable that said compressor unit sucks the air in the refrigerating-storage room to be compressed and supplied to said air tank.

The defrosting system is provided with a plurality of coolers in said refrigerating-storage room, each of the coolers is provided with said compressed air blowing means, the compressed air blowing means being provided with said valve mechanism, and defrosting control is carried out by means of said control unit which controls the opening and closing of the valve mechanism at a predetermined interval.

It is suitable that a temperature detection means is disposed in said refrigerating-storage room, and said defrosting control is carried out when the temperature in the refrigerating-storage room detected by said temperature detection means exceeds a predetermined threshold value.

Further, it is preferable that said compressed air blowing means has a looped nozzle body, a plurality of holes being formed in the nozzle body for allowing the compressed air supplied from the air tank to blow out from the holes.

DETAILED DESCRIPTION OF THE PREFERRED EMBODIMENTS

The present invention will now be detailed with reference to accompanying drawings.

Figure 1:
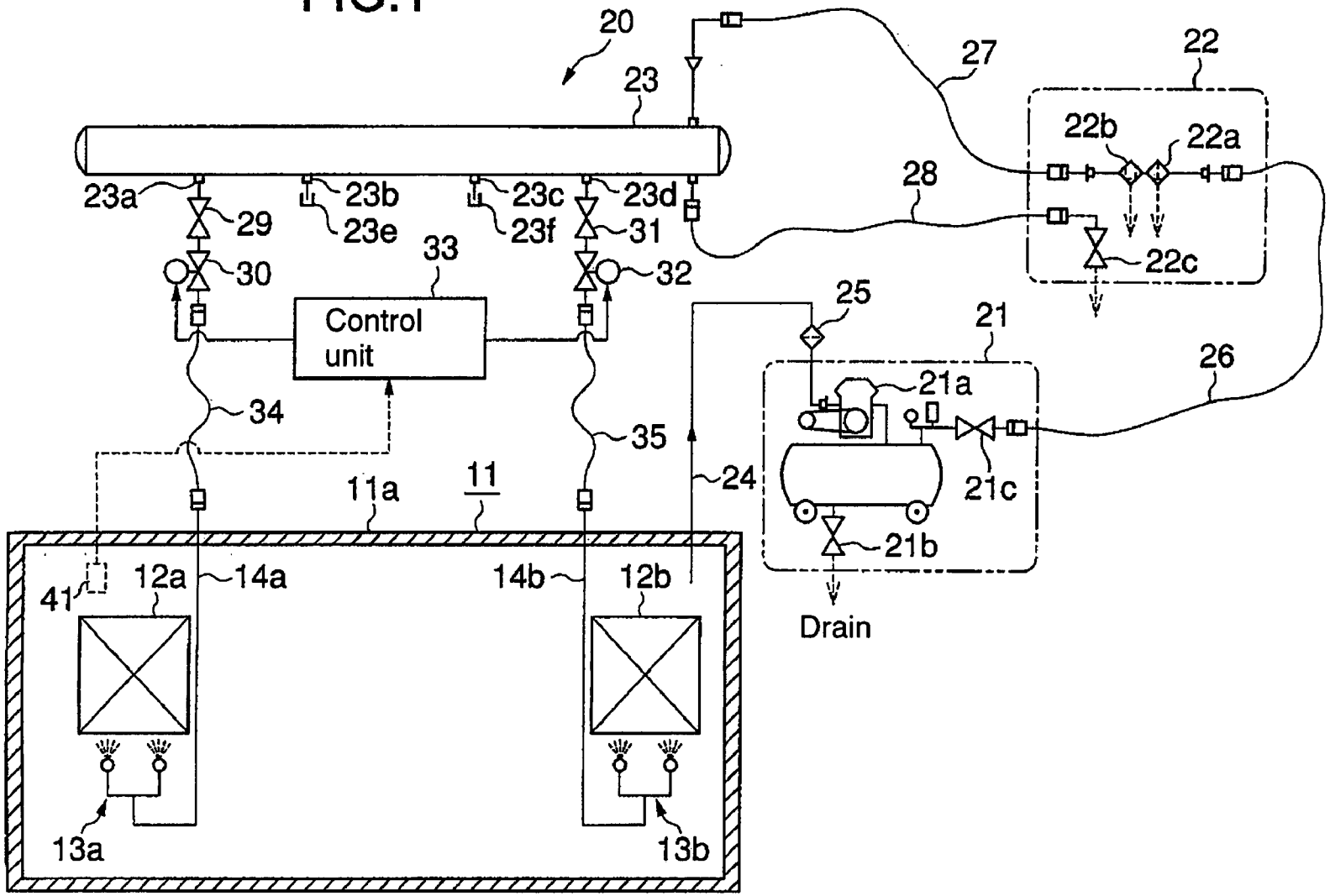
FIG. 1 is a block diagram showing an example of defrosting system according to the present invention.

Referring to FIG. 1, the defrosting system 20 shown in FIG. 1 is applied for removing the frost deposited on the cooling coil (not shown in the drawing) of a cooler 12*a* and 12*b* disposed in a refrigerating-storage room 11. A plurality of coolers 12*a*, 12*b* are located in the storage room 11, of which two coolers, i.e. the entrance side cooler 12*a* and exit side cooler 12*b* are shown in this example.

The refrigerating-storage room 11 is covered with an insulation panel 11*a* by which heat intrusion from outside is prevented. Injection nozzles 13*a* and 13*b* are provided facing the cooler 12*a* and 12*b* respectively. In the example shown in the drawing, each of the injection nozzle 13*a* and 13*b* has two nozzle head. Each of the nozzles 13*a* and 13*b* is connected with the defrosting system 20 located outside the refrigerating-storage room 11.

The defrosting system 20 comprises a compressor unit 21, a filter unit 22, and an air tank (air header) 23. Compressed air will be supplied to the injection nozzle 13*a* and 13*b* by way of a piping 14*a* and 14*b* respectively as mentioned later.

On the other hand, a air suction piping 24 is provided at the ceiling of the refrigerating-storage room 11, the one end of the piping 24 being opened to the refrigerating-storage room 11. The other end of the piping 24 is connected to the compressor unit 21 by way of an air filter 25, and the air in the storage room 11 is sucked by the compressor unit 21 through the piping 24 to be compressed.

The compressor unit 21 is provided with a compressor 21*a* and opening/closing valves 21*b* and 21*c*. When the opening/closing valve 21*b* is opened, the water condensate in the compressor 21*a* is drained. The opening/closing valve 21*c* is provided at the discharge side of the compressor 21*a*. When the valve 21*c* is opened, the compressed air is introduced to the filter unit 22 through a piping 26.

The filter unit 22 is provided with an air filter 22*a*, a mist separator 22*b*, and an opening/closing valve 22*c*. The compressed air is filtered through the air filter 22*a*, and further the mist in the compressed air is separated by the mist separator 22*b* to be drained. The compressed air passed through the filter unit 22 is introduced by way of a piping 27 to the air tank 23 to be stored there temporarily. Further a piping 28 is connected to the air tank 23, and the piping 28 is connected to an opening/closing valve 22*c* provided in the filter unit 22. When the valve 22*c* is opened, the water accumulated in the air tank 23 is drained.

Four jointing parts 23*a*~23*d* are provided to the air tank 23 in the example shown in FIG. 1. In FIG. 1, only two coolers are disposed in the storage room 11 and the jointing parts 23*b*, 23*c* are plugged with plugs 23*e*, 23*f* respectively.

An opening/closing valve 29 is connected to the jointing part 23*a* and an electromagnetic valve 30 is connected to the opening/closing valve 29. Similarly, an opening/closing valve 31 is connected to the jointing part 23*d* and an electromagnetic valve 32 is connected to the opening/closing valve 31. Opening/closing of the electromagnetic valve 30 and 32 is controlled by a control unit 33 as described later. To each of the electromagnetic valves 30, 32 is connected a piping 34 and 35 respectively, and the piping 34 and 35 are connected to the piping 14*a* and 14*b* respectively.

When carrying out defrosting of the coolers 12*a*, 12*b*, opening/closing valves 21*c*, 29, and 31 are opened and the compressed air in the air tank 23 compressed by the compressor unit 21 is blown on to the cooling coils of the coolers 12*a*, 12*b*.

Figure 2:
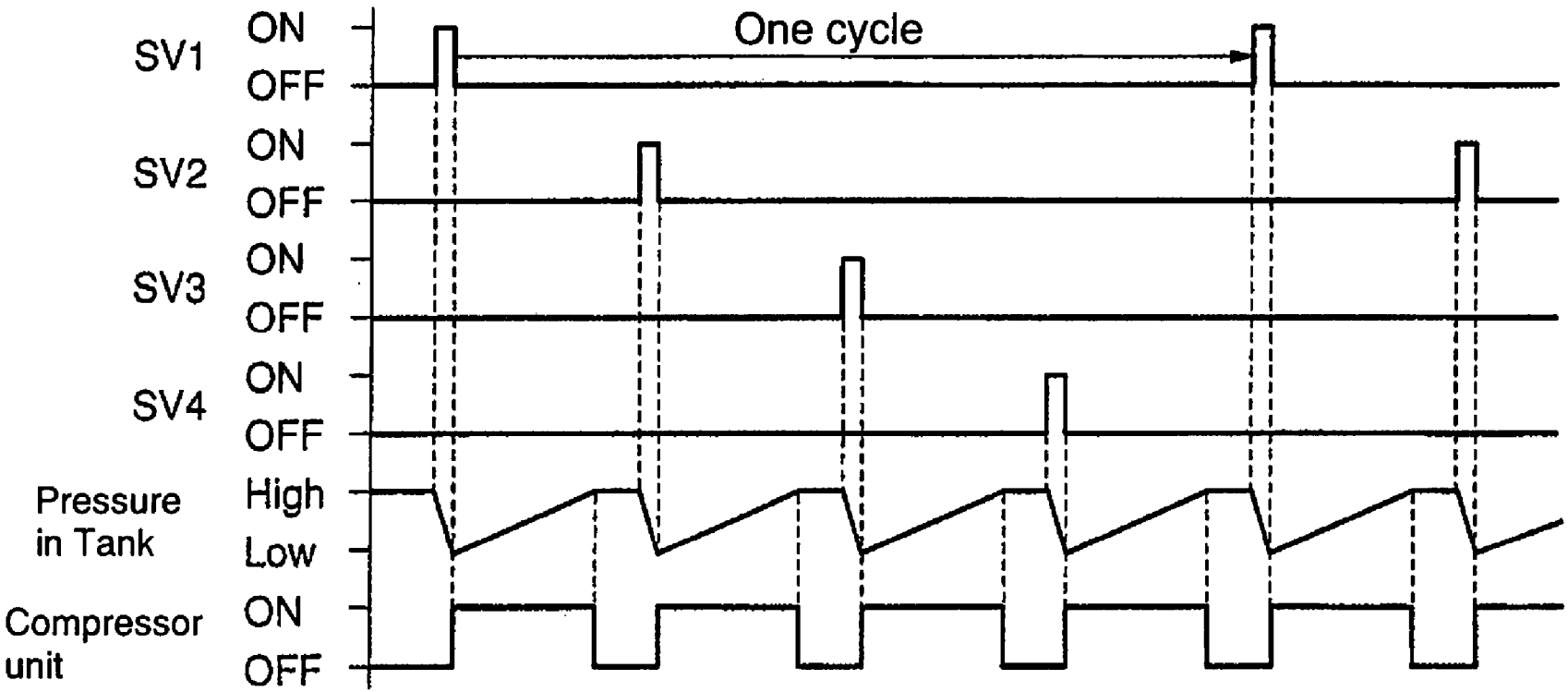
FIG. 2 is a timing chart for explaining the timing of carrying out defrosting of the defrosting system of FIG. 1.

FIG. 2 shows the timing of opening/closing of the electromagnetic valves. Here, for the sake of easy understanding of the opening/closing timing of the electromagnetic valves, it is supposed that an opening/closing valve and electromagnetic valve are connected also to the jointing parts 23*b*, 23*c* respectively, and that coolers and injection nozzles connected to the jointing parts 23*b*, 23*c* are disposed in the refrigerating-storage room 11, that is, four coolers are located in the storage room. In FIG. 2, the electromagnetic valve 30 and 32 is respectively denoted by SV1 and SV4, and those connected to the jointing parts 23*b*, 23*c* are denoted respectively by SV2, SV3.

A program for controlling opening/closing of the electromagnetic valves SV1~SV4 is inputted beforehand in the control unit 33. The pressure in the air tank 23 is in an increased state "High" as shown in FIG. 2 when defrosting is started. The control unit 33 controls the opening/closing of the electromagnetic valves SV1~SV4 according to the programmed timing, for example, each of the electromagnetic valves SV1~SV4 is actuated at an interval of 30 minutes.

For example, the electromagnetic valve SV1 is opened for a certain period of time (for example, for 0.5~1.0 second), during which period the compressed air in the air tank 23 is introduced to the corresponding injection nozzle. The pressure in the air tank 23 decreases to a state "Low" as shown in FIG. 2 by the blowing out of air from the nozzle. When the pressure in the air tank 23 is decreased to "Low", the compressor unit is driven to supply compressed air from the compressor unit 21 to the air tank 23. (The compressor unit is started to be driven when the electromagnetic valve SV1 is closed.)

When tank pressure becomes "High", the operation of the compressor unit is stopped. The control unit 33 allows the electromagnetic valve SV2 to open according to the predetermined timing and the compressed air in the air tank 23 is introduced to the corresponding nozzle to be blown out. When the pressure in the air tank 23 is decreased to "Low" by the blowing out of the air, the compressor unit is driven to supply compressed air from the compressor unit 21 to the air tank 23 until the pressure in the air tank 23 becomes "High", when the operation of the compressor unit is stopped.

Similarly, the control unit 33 allows the electromagnetic valve SV3 to open according to the predetermined timing and the compressed air in the air tank 23 is introduced to the corresponding nozzle to be blown out. When the pressure in the air tank 23 is decreased to "Low" by the blowing out of the air, the compressor unit is driven to supply compressed air from the compressor unit 21 to the air tank 23. When tank pressure becomes "High", the operation of the compressor unit is again stopped. The control unit 33 allows the electromagnetic valve SV4 to open according to the predetermined timing and the compressed air in the air tank 23 is introduced to the corresponding nozzle to be blown out. When the pressure in the air tank 23 is decreased to "Low" by the blowing out of the air, the compressor unit is driven to supply compressed air from the compressor unit 21 to the air tank 23.

In this way, the control unit 33 allows the electromagnetic valves SV1~SV4 to open and close according to a predetermined timing to supply compressed air to the corresponding nozzle, and the frost deposited on to the cooling coils of the coolers is blown off by the compressed air, thus defrosting of coolers is carried out. The control unit 33 controls to allow compressed air to blow out intermittently from each of the nozzle.

As has been explained, in the above example, the electromagnetic valves are opened intermittently, so that it is not necessary to stop the refrigerating operation for defrosting the coolers, the capacity of the air tank 23 can be reduced, and the capacity of the compressor unit 21 also can be reduced. As a result, the defrosting of the coolers disposed in the refrigerating-storage room can be carried out with low cost and high efficiency.

Further, in the above example, as the air in the refrigerating-storage room is sucked by the compressor unit 21 to be compressed, the temperature of the compressed air is not so high, and the heat load for the coolers due to the blowing of the compressed air is low and the cooling effect of the coolers to cool the storage room is not reduced.

In the above example, each of the electromagnetic valves SV1~SV4 is opened at intervals with which the cooling performance of the coolers is not affected by the frost deposited on the coolers during the period of time between the intervals.

In the above example, the case where the electromagnetic valves SV1~SV4 are opened on a controlled cycle programmed in the control unit 33 was explained. However, it is suitable that a temperature sensor 41 is disposed in the refrigerating-storage room 11 as shown by a broken line in FIG. 1 so that the control unit 33 controls the cycle time to open the electromagnetic valves SV1~SV4 according to the temperature of the storage room detected by the sensor 41.

The cooling performance of the coolers decreases when the amount of the frost deposited on the coolers increase, as a result the temperature in the storage room increases. Therefore, it is suitable to control so that the electromagnetic valves SV1~SV4 open when the temperature in the storage tank is higher than a predetermined threshold temperature. In this case also the control unit 33 controls so that the electromagnetic valves SV1~SV4 are opened at a predetermined cycle time.

Figure 3:
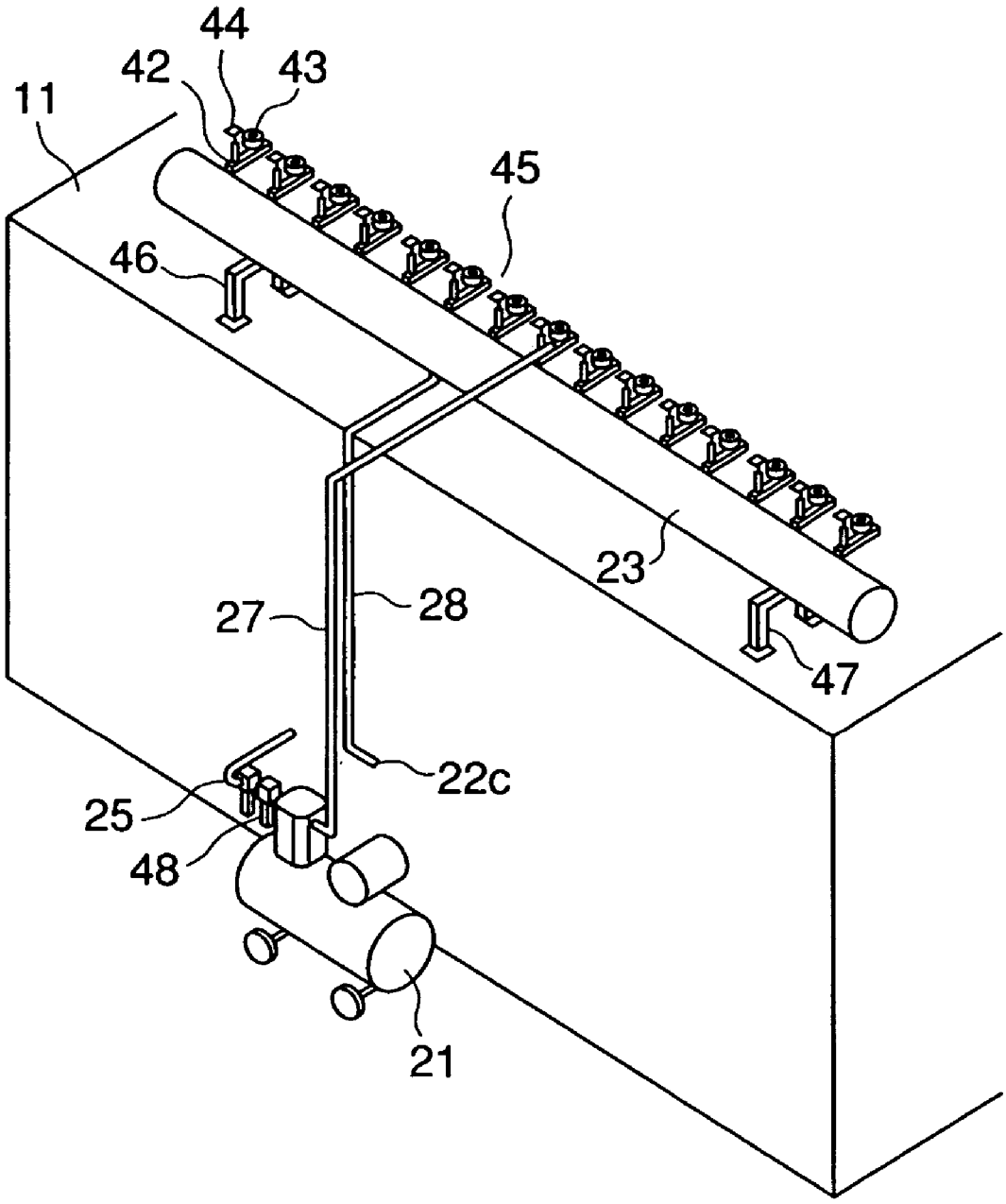
FIG. 3 is a perspective view showing the piping of the defrosting system of FIG. 1 together with the compressor unit.

Referring to FIG. 3 showing an example of the state the air tank 23 is attached to the refrigerating-storage room 11, fifteen jointing parts 42 are provided to the air tank 23. These joint parts 42 are similar to the joint parts 23*a*~23*d* shown in FIG. 1. To these joint parts 42 are connected the injection nozzles (not shown in FIG. 3) by way of electromagnetic valves 43 selectively as necessary. In the drawing, fifteen electromagnetic valves 43 are connected, the valves being similar as the electromagnetic valves 30, 32 shown in FIG. 1.

In FIG. 3, fifteen opening/closing valves 44 which are similar to the opening/closing valves 29, 31 can be recognized, and a pressure gage 45 is attached to the jointing part 42 located in the mid jointing part.

The air tank 23 is supported by a pair of support member 46, 47, which is attached to the top of the storage room 11 by means of rivets or the like. The compressor unit 21 is a mobile one placed on the floor outside the refrigerating-storage room 11. In this example, an air filter 25 and a mist separator 48 are provided to the suction side of the compressor unit 21 instead of the filter unit 22 as shown in FIG. 1. When the air filter unit 22 as shown in FIG. 1 is not used, the piping 28 connecting to the air tank 23 is provided to run along the side wall of the storage room 11, and the opening/closing valve 22*c* as shown in FIG. 1 is attached to the opening end of the piping 28.

Figure 4:
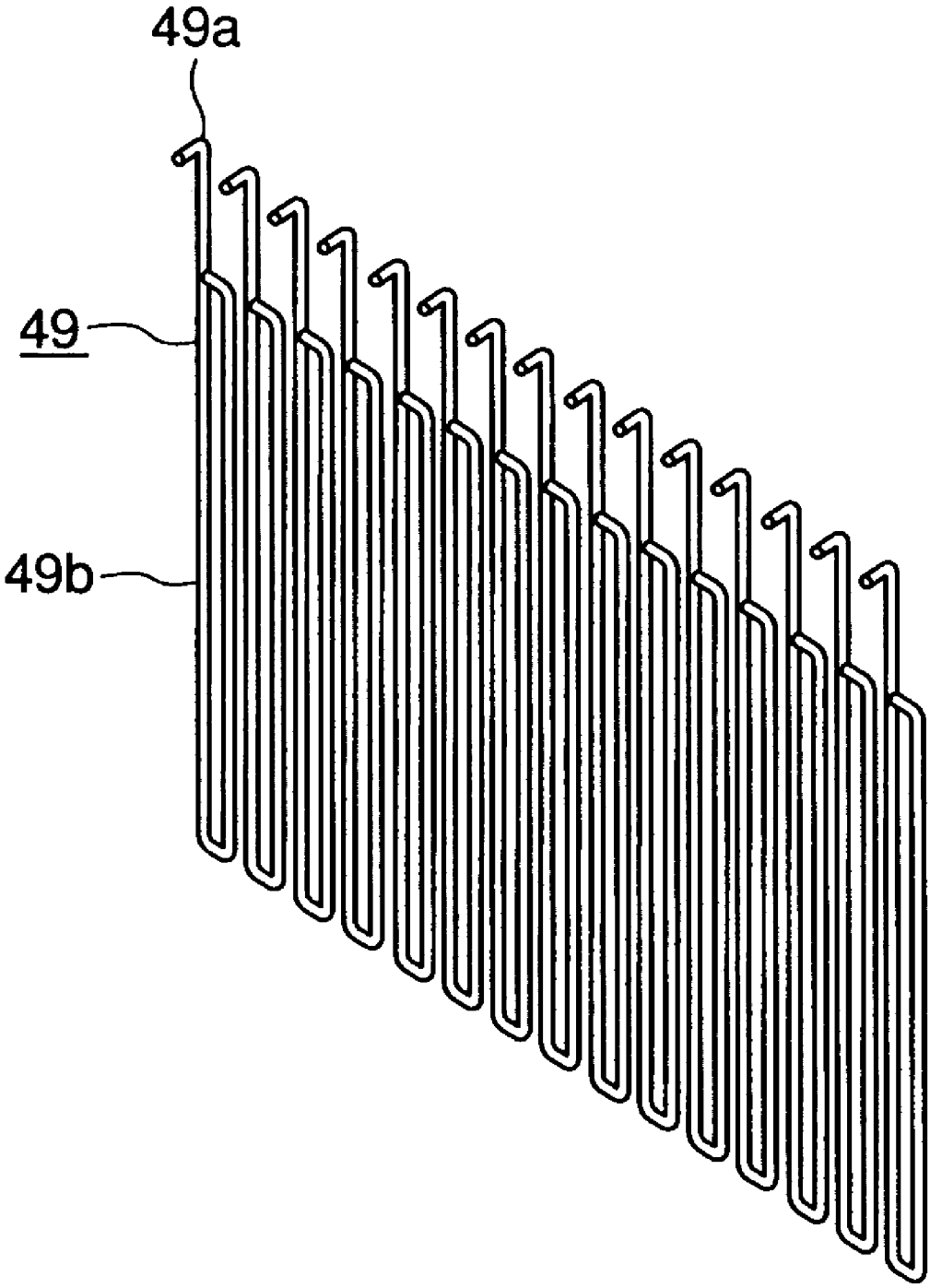
FIG. 4 is a perspective view showing the nozzle part disposed in the refrigerating-storage room.

Referring to FIG. 4 showing an example of injection nozzles in a perspective view, fifteen nozzles 49 are provided to be connected to fifteen jointing parts 42 (see FIG. 3). Each injection nozzle 49 consists of a connection part 49*a* to be connected to the jointing part 42 by means of a piping and electromagnetic valve and a nozzle body 49*b*, the nozzle body being formed in a loop, a number of holes (not shown in the drawing) directed to face the corresponding cooler being arranged in a longitudinal direction along the nozzle body 49*b*.

By forming the nozzle body 49*b* in a looped shape having a number of holes to blow out compressed air, the compressed air can be blown uniformly all over the cooler (cooling coil), and the frost deposits can be effectively blown off from the cooler.

INDUSTRIAL APPLICABILITY

As compressed air is blown onto the coolers intermittently for removing the frost deposited on the cooler, the defrosting of the coolers in a refrigerating-storage room can be carried out with low cost and high efficiency.

What is claimed is:

1. A defrosting system for removing frost deposits from a cooling device disposed in a refrigerating-storage room for cooling the inside of the room, comprising a compressed air blowing means to blow compressed air on to said cooling device or devices, and a compressed air supply means to supply compressed air intermittently to said compressed air blowing means, wherein said compressed air supply means comprises an air tank for storing compressed air, a compressor unit for supplying compressed air to said air tank, and a control means for controlling so that the compressed air in said air tank is supplied intermittently to said compressed air blowing means.

2. The defrosting system according to claim 1, wherein said control means comprises a valve mechanism disposed between said compressed air blowing means and said air tank, and a control unit for allowing the valve mechanism to open intermittently to supply compressed air from said air tank to said compressed air blowing means.

3. The defrosting system according to claim 1, wherein said compressor unit sucks the air in the refrigerating-storage room to be compressed and supplied to said air tank.

4. The defrosting system according to claim 2, wherein a plurality of coolers are provided in said refrigerating-storage room, each of the coolers is provided with said compressed air blowing means, the compressed air blowing means being provided with said valve mechanism, and defrosting control is carried out by means of said control unit which controls the opening and closing of the valve mechanism at a predetermined interval.

5. The defrosting system according to claim 4, wherein a temperature detection means is disposed in said refrigerating-storage room, and said defrosting control is carried out when the temperature in the refrigerating-storage room detected by said temperature detection means exceeds a predetermined threshold value.

6. A defrosting system for removing frost deposits from a cooling device disposed in a refrigerating-storage room for cooling the inside of the room, comprising a compressed air blowing means to blow compressed air on to said cooling device or devices, and a compressed air supply means to supply compressed air intermittently to said compressed air blowing means, wherein said compressed air blowing means has a looped nozzle body, a plurality of holes being formed in the nozzle body for allowing the compressed air supplied from the air tank to blow out from the holes.

7. The defrosting system according to claim 2, wherein said compressor unit sucks the air in the refrigerating-storage room to be compressed and supplied to said air tank.

* * * * *